United States Patent [19]

Lambe

[11] Patent Number: 4,728,851

[45] Date of Patent: Mar. 1, 1988

[54] FIELD EMITTER DEVICE WITH GATED MEMORY

[75] Inventor: John J. Lambe, Altadena, Calif.

[73] Assignee: Ford Motor Company, Dearborn, Mich.

[21] Appl. No.: 338,463

[22] Filed: Jan. 8, 1982

[51] Int. Cl.[4] ..... H01J 1/02

[52] U.S. Cl. ..... 313/309; 313/336; 313/530

[58] Field of Search ..... 313/5, 495, 497, 532, 313/309, 336, 351, 306, 308, 310, 529, 530

[56] References Cited

U.S. PATENT DOCUMENTS

| | | | |
|---|---|---|---|
| 2,926,286 | 2/1960 | Skellett | 313/495 |
| 3,921,022 | 11/1975 | Levine | 313/309 |
| 3,970,887 | 7/1976 | Smith et al. | 313/309 |
| 3,998,678 | 12/1976 | Fukase et al. | 156/3 |
| 4,095,133 | 6/1978 | Hoeberechts | 313/336 |

OTHER PUBLICATIONS

McGraw-Hill Encyclopedia of Science and Technology; vol. 3, pp. 274–275; 1966.

*Primary Examiner*—William L. Sikes
*Assistant Examiner*—Robert E. Wise
*Attorney, Agent, or Firm*—Paul K. Godwin, Jr.; Clifford L. Sadler

[57] ABSTRACT

A field emitter device utilizing a gate electrode adjacent a carbon fiber electron emitter cathode for controlling the initial flow of electrons between the cathode and a collector element. Subsequent disconnect of the gate electrode from its power source does not affect the electron flow and thereby provides a bistable memory type device. Luminescent material on the collector provides a light emission display at points corresponding to electron flow between the emitter and the collector.

13 Claims, 1 Drawing Figure

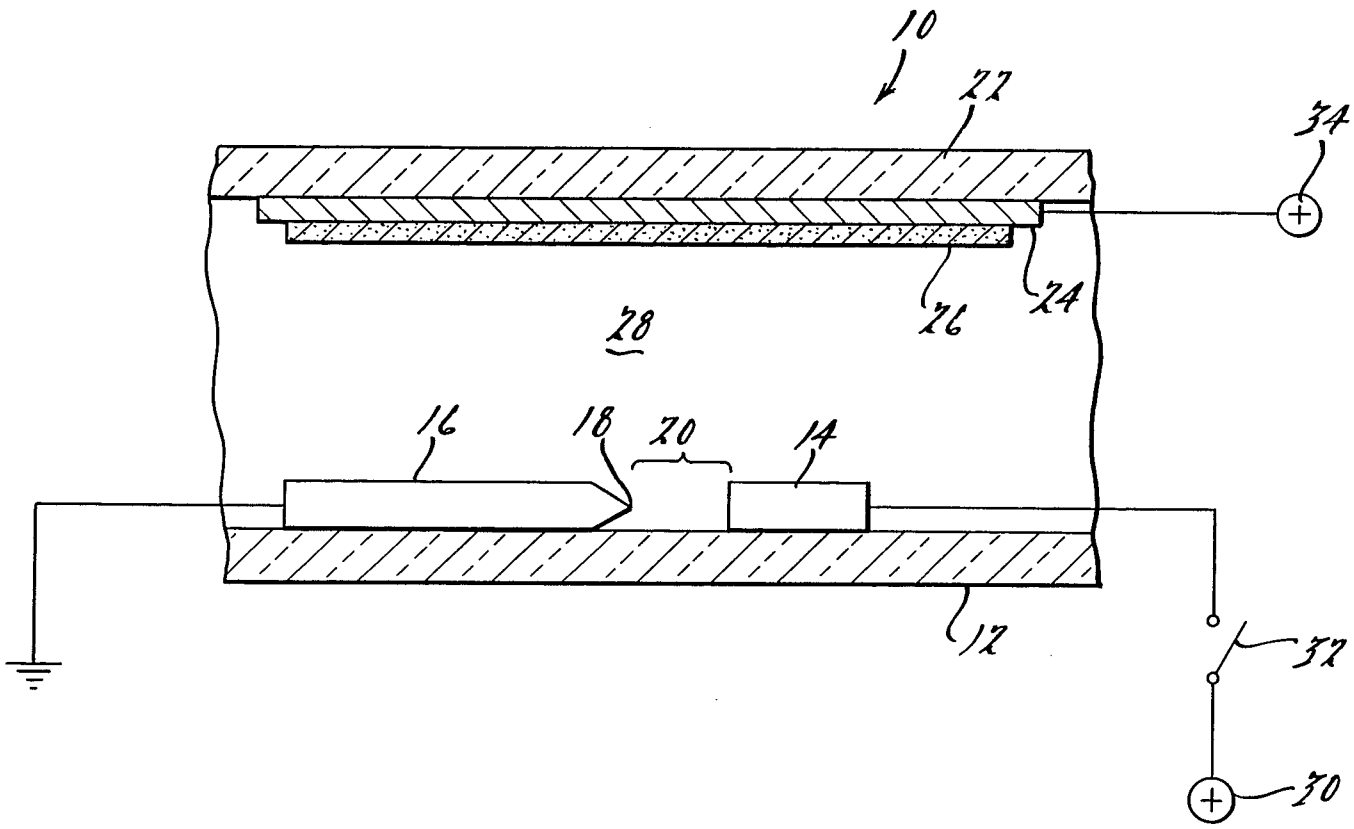
34
74
10
72
76
28
18
16
70
14
12
32
30

FIELD EMITTER DEVICE WITH GATED MEMORY

BACKGROUND OF THE INVENTION

1. Field of the Invention:

The present invention is directed to electron field emission devices and to displays which incorporate electron field emission devices.

2. Description of the Prior Art:

Many types of non-thermionic (cold cathode) type field emitting devices have been disclosed in the prior art. Generally, an electric potential is applied near a pointed cathode in a vacuum to stimulate electron emission therefrom. U.S. Patents, such as: U.S. Pat. Nos. 3,921,022; 3,970,887; 3,998,678; and 4,095,133, illustrate fabrication techniques for field emitting devices utilizing evaporation and etching steps to form upwardly pointed cathodes and apertured accelerating electrodes on a flat surface. In the patents, materials, such as copper and silicon are used to form the cathodes since those materials are generally accepted as having good field emission characteristics. However, such materials erode after prolonged use and would not be suitable in display apparatus subjected to heavy use over prolonged periods of time. In addition, each of the devices disclosed in the aforementioned patents, requires constant application of voltage to the apertured accelerating electrode and its associated collector electrode to effect electron flow between the cathode and the collector. In a matrix type display device composed of a plurality of such field emitting devices, each accelerating electrode would necessarily require addressing for each scan period to maintain the display illumination.

SUMMARY OF THE INVENTION

The present invention is intended to improve the durability and reliability of non-thermionic type field emitting devices by providing a cathode formed of a material that is a good field emitter and is highly resistive to errosion.

The present invention is also intended to provide a bistable field emitting device that requires only initial addressing to initiate a flow of electrons between its field emitter cathode and a collector electrode.

The above intentions are achieved by utilizing a carbon filament cathode and a gate electrode adjacently disposed on a common substrate surface so that the pointed end of the carbon filament is spaced from the gate electrode. A collector electrode is formed on an opposing substrate surface across a vacuum space from the filament. When appropriate positive voltages are applied to the gate electrode and collector and the cathode is grounded, a strong field at the cathode causes electron emission from the cathode. Once emission occurs, the voltage to the gate electrode is inhibited (open circuit) and electrons continue to flow between the cathode and the collector.

In a display embodiment, the collector may be coated with a luminescent material so that the impingement of electrons thereon will produce light emissions. Of course, such a display embodiment dictates that at least one of the substrates be transparent to allow output of the light emitted by the luminescent material.

BRIEF DESCRIPTION OF THE DRAWING

The FIGURE illustrates the present invention as embodied in a display device.

DETAILED DESCRIPTION OF THE PREFERRED EMBODIMENT

The FIGURE illustrates the present invention embodied in vacuum fluorescent display device 10, wherein the various elements are schematically illustrated as being connected to appropriate voltage supply and grounding means.

The display device 10 includes a first substrate element 12 having outer and inner surfaces with respect to the display device. The inner surface of the substrate 12 provides for the laterally spaced mounting of a carbon filament cathode element 16 and a gate electrode 14. The carbon filament cathode element 16 contains a pointed end 18 that is directed towards the gate electrode 14, formed of indium and disposed across a space 20 from the cathode 16. The space 20 separating the point 18 of the carbon fiber cathode 16 and the gate electrode 14 is on the order of 0.5 mm.

A second substrate 22 is disposed across a vacuum space 28 and has an inner surface, upon which a collector electrode 24 is formed. The collector electrode 24 may be of any material which is conductive, such as aluminum or copper. In the display device 10, luminescent material 26 is formed on the collector electrode 24.

The diameter of the carbon fiber cathode 16 is on the order of two microns. While the carbon fiber material is commonly available in the 6–8 micron range, it was necessary to reduce its diameter by utilizing an r.f. oxygen plasma. Subsequently, the endpoint 18 was sharpened by corona discharge to a cross-section of approximately 2000 Angstroms.

In operation, the carbon filament cathode 16 is connected to an electron source (grounded); the gate electrode 14 is connected through a switch 32 to a positive voltage potential 30, which is on the order of 300 volts DC; and the collector electrode 24 is connected to a relatively positive voltage source 34, which is on the order of 600 volts DC. Initially, when the switch 32 is open, no electrons are emitted from the cathode 16 and no light is emitted by the device 10. However, when the switch 32 is closed, electron emission commences from the tip 18 of the cathode 16. The electrons flow across the vacuum space 28; impinge on the luminescent material 26, to cause it to emit light; and are received by the collector electrode 24. Subsequently, after the electron flow has commenced between the cathode 16 and the collector 24, the gate electrode 14 may be disconnected by opening switch 32, without affecting the flow of electrons. Suspension of electron flow and the resultant stoppage of light emission is achieved by interrupting the electrical circuit between the cathode 16 and the collector electrode 24 (e.g. disconnecting voltage source 34 or interrupting the ground connection).

It should be seen that the present invention has the distinct advantage of a bistable field emitter device, since a positive potential pulse to the gate electrode 14 causes the state of the device to change from an off state to full electron emission. The advantages of such a device are especially appreciated in a display where several individual emission cathodes and associated memory gates are arranged in an X-Y matrix pattern, since the present invention would not require periodic addressing of the memory gate in order to maintain a particular display pattern.

While it is apparent that many modifications and variations may be implemented without departing from the scope of the novel concept of this invention, it is intended by the appended claims to cover all such modifications and variations which fall within the true spirit and scope of the invention.

I claim:

1. A bistable field emitter comprising:

a filament cathode element having an electron emitting end;

a collector electrode disposed across an evacuated space from said filament cathode in a first direction therefrom;

a gated electrode spaced from the electron emitting end of said filament cathode by a predetermined amount along a plane orthogonal to said first direction;

said electron emitting end of said filament cathode being disposed to point in a second direction orthogonal to said first direction;

whereby a voltage potential of a first predetermined level is applied between said filament cathode and said collector electrode that is not sufficient to cause electron emission from said cathode until a voltage potential of the second predetermined level is applied to said gating electrode, but is sufficient to sustain electron emission from said cathode when said voltage potential of said second predetermined level is subsequently disconnected from said gating electrode.

2. A bistable field emitter as in claim 1, wherein said filament cathode element and said gating electrode are commonly mounted on a first planar substrate and said second direction is parallel to the substrate plane.

3. A bistable field emitter as in claim 2, wherein said collector electrode is mounted on a second planar substrate and said first and second substrates are oppositely disposed to define said evacuated space.

4. A bistable field emitter as in claim 3, wherein at least one of said first and second planar substrates is transparent to visible electromagnetic radiation and said collector electrode is coated with a luminescent film that emits visible electromagnetic radiation through said at least one transparent substrate when electrons flow between said filament cathode element and said collector electrode.

5. A field emitter device comprising:

a first substrate having defined inner and outer surfaces;

a second substrate having defined inner and outer surfaces;

said inner surfaces of said first and second substrates being oppositely disposed across an evacuated space;

cathode means for supplying electrons to said space, said cathode means being disposed on the inner surface of said first substrate and being connected to an electron source;

collector means for collecting electrons flowing across said space from said cathode means, said collector means being disposed on the inner surface of said second substrate and being connected to a first relatively positive voltage potential; and gate electode for initiating said flow of electrons between said cathode means and said collector, said gate electrode means being disposed on said inner surface of said first substrate, laterally spaced from said cathode means by a predetermined amount and being switchably connectable to a second relatively positive voltage potential and wherein said cathode means is a carbon filament having a field emitting end point oriented along said inner surface of said first substrate and directed towards said gate electrode.

6. A device, as in claim 5, wherein said collector means is a layer of conductive material deposited on said internal surface of said second substrate.

7. A device, as in claim 6, wherein one of said substrates is transparent, said collector means is coated with a luminescent film; and said device emits electromagnetic radiation through said transparent substrate when electrons flow between said cathode means and said collector means.

8. A device, as in claim 7, wherein said gate electrode is formed of a conductive material deposited on said internal surface of said first substrate and is connected to a switching means for selectably completing and inhibiting a low resistance electrical path between said gate means and said second voltage potential.

9. A device, as in claim 8, wherein said fiber filament is formed to have a maximum diameter of approximately two microns and a field emitting end point that is on the order of 1000–2000 Angstroms in diameter.

10. A device, as in claim 9, wherein predetermined space between said fiber filament endpoint and said gate is approximately 0.5 mm.

11. A device, as in claim 6, wherein said gate electrode is formed of a conductive material deposited on said internal surface of said first substrate and is connected to a switching means for selectably completing and inhibiting a low resistance electrical path between said gate and said second voltage potential.

12. A device, as in claim 11, wherein said fiber filament is formed to have a maximum diameter of approximately two microns and a field emitting end point that is on the order of 1000–2000 Angstroms in diameter.

13. A device, as in claim 6, wherein said carbon filament is connected to ground potential, said first relatively positive voltage potential is approximately 600 volts; and said second relatively positive potential is approximately 300 volts; wherein said flow of electrons between said carbon filament and said collector means is commenced when said first and second potentials are respectively connected to said collector means and gate electrode and said flow of electrons is thereafter maintained when said second potential is disconnected from said gate electrode.

* * * * *